US006261122B1

(12) United States Patent
Richter

(10) Patent No.: US 6,261,122 B1
(45) Date of Patent: Jul. 17, 2001

(54) FIXTURE LOWERING ASSEMBLY

(75) Inventor: Thomas Richter, Fox River Grove, IL (US)

(73) Assignee: North Star Lighting, Broadview, IL (US)

( * ) Notice: Subject to any disclaimer, the term of this patent is extended or adjusted under 35 U.S.C. 154(b) by 0 days.

(21) Appl. No.: 09/330,936

(22) Filed: Jun. 11, 1999

(51) Int. Cl.[7] ..... H01R 13/00
(52) U.S. Cl. ..... 439/477
(58) Field of Search ..... 439/477, 248, 439/372, 378, 379, 380, 247; 362/403

(56) References Cited

U.S. PATENT DOCUMENTS

| | | | | |
|---|---|---|---|---|
| 4,429,355 | * | 1/1984 | Garchinsky | 362/403 |
| 5,383,790 | * | 1/1995 | Kerek et al. | 439/248 |
| 5,393,245 | | 2/1995 | Hinds, Jr. | 439/477 |
| 5,718,602 | * | 2/1998 | Savoca | 439/477 |

* cited by examiner

*Primary Examiner*—Brian Sircus
*Assistant Examiner*—Javid Nari
(74) *Attorney, Agent, or Firm*—Dennis A. Gross

(57) ABSTRACT

A fixture lowering assembly for lowering fixtures, such as security and surveillance cameras, that require connection and disconnection of multiple complex electrical contacts is disclosed. The assembly includes a fixed housing that is mounted above ground level and a movable housing containing the fixture and being capable of being lowered to the ground level. A connect unit connects the fixed and movable housings and includes a latching assembly and first and second electrical connectors. The first and second connectors are each mounted on a pair of guide rods that extend through a pair of springs so that the first and second connectors freely float to facilitate connection and disconnection. The electrical connectors also include mounting bodies capable of receiving a variety of different electrical contact plates depending upon the type of fixture used with the lowering assembly. This construction of the contact plates also provides a moisture proof seal about the pins and sockets. The electrical contact plates include pin and socket electrical contacts and the pins are mounted on one of the plates in recesses below the outer surface of the plate in order to protect the pins from inadvertent damage. The opposite plate includes projections that engage the recesses in the opposite plate in order to ensure correct alignment between the pins and sockets. The electrical contact plates and the mounting posts for the first and second connectors may also include, respectively, leading alignment members and leading alignment posts to further facilitate correct alignment of the electrical contacts.

27 Claims, 5 Drawing Sheets

FIXTURE LOWERING ASSEMBLY

BACKGROUND OF THE INVENTION

This invention generally relates to assemblies for lowering an electrical fixture from elevated locations and more particularly to a fixture lowering assembly adapted for lowering suspended fixtures, such as security and surveillance cameras, that require connection and disconnection of multiple complex electrical contacts.

Fixture lowering assemblies for devices such as mast-supported street lights or other lighting devices positioned at a high elevation are well known. U.S. Pat. No. 5,393,245 discloses such a lowering assembly for lowering a light fixture for servicing. The device includes a standard three-prong electrical plug that must be connected and disconnected when lowering the light fixture.

Many of such prior art devices are not suitable for providing a connection for more complicated electrical fixtures, such as cameras, video recorders and the like. This is because such complex electrical devices require many more electrical contacts for providing power to the device and permitting transmission of signals from the device, such as a camera, back to a receiving or viewing station. The complexity of the electrical connection can hinder the disconnecting or connecting process and can also cause damage to the fixture if there is ununiform disconnection or connection of only some of the electrical contacts.

U.S. Pat. No. 5,718,602 discloses a suspension connector assembly designed for use with more complex electrical devices such as cameras that require multiple pin and barrel-type socket electrical connectors. However, the pins 55 of the electrical connection project outwardly from a rubber base 7 with no mechanism provided on the base 7 for guiding the pins 55 into the sockets on the other half of the connector. The pins 55 may therefore encounter difficulty in finding the corresponding sockets and could potentially be damaged during attempted insertion into the sockets. The base 7 of the pins 55 is also rigidly fixed and therefore cannot compensate for any variation in the connection process. This rigid fixation of the pins, while an upward force is being applied, further enhances the possibly of misalignment, bad connection, or damage to the pins 55.

SUMMARY OF THE INVENTION

One object of the present invention is to provide an improved fixture lowering assembly for use with, for example, security or surveillance cameras that have multiple contact positions required to form an adequate electrical connection. For example, in an embodiment, the fixture lowering assembly can provide up to twenty-nine contact positions for use with a variety of different security and surveillance cameras for disconnecting and connecting the power and signal wires so that the camera may be lowered for maintenance. However, it will be understood that the fixture lowering assembly of the present invention can be used with a variety of electrical fixtures requiring varying types of electrical connections.

The fixture lowering assembly of the present invention provides an improved electrical connection by providing first and second connectors, each respectively provided with pins and sockets, that both have a biased mounting that permits both the first and second connector to float. The first and second connectors are preferably mounted on respective sets of upper and lower guide posts with springs mounted therein for providing a floating effect to the first and second connector. By providing a spring mounting and permitting both the first and second connectors to float, the first and second connectors can adequately compensate for variations in alignment and force during the connection process in order to facilitate an effective connection between the pins and the sockets.

The fixture lowering assembly of the present invention is also designed to protect the pins provided on the connector during the connection process. This is accomplished by providing on the ends of the guide posts that hold the first and second connectors with a respective set of alignment posts and receptacles that cooperate to engage and align the first connector with the second connector. The alignment posts and receptacles preferably come into contact before the pins and sockets in order to ensure a proper alignment.

To further facilitate accurate correction, the contact pins are provided in a recess or recess on the connector so if the pins are in a protective environment in order to prevent an pertinent damage, such as bending of the pins. The opposite connector includes projections (which house the electrical sockets) that fit into the recess on the other connector prior to engagement of the pins with the sockets to further ensure proper alignment with the pins and the sockets.

Another object of the present invention is to provide an improved fixture lowering assembly that can be used with a variety of electrical connections, such as for security and surveillance cameras, video cameras, etc. This is accomplished by providing the first and second connectors with mounting bodies that are capable of receiving a variety of electrical contact plates. The electrical contact plates can be selected for the particular intended fixture and easily placed within the mounting bodies of the first and second connectors.

In an embodiment, the fixture lowering assembly of the present invention comprises a fixed housing mounted above ground level and a movable fixture housing connected to a fixture. A connect unit is used to secure the fixed housing to the movable housing and includes an upper portion mounted on the fixed housing and the lower portion mounted on the movable housing. A latching assembly is provided on the upper and lower halves of the connect unit for permitting selective connection and disconnection of the two halves of the connect unit as well as the fixed and movable housings.

The upper portion of the connect unit includes a first electrical connector and the lower portion of the connect unit and includes a second electrical connector. A first spring assembly resiliently mounts the first connector on the upper portion of the connect unit and a second spring assembly resiliently mounts the second connector on the lower portion of the connect unit. The first and second connector each include electrical contacts for forming the electrical connection required for the fixture.

The first and second connectors are preferably comprised on a mounting body and a selected electrical contact plate provided in the mounting body. The electrical contact plates can be easily removed from the mounting bodies and replaced in order to adapt to the circuitry required for a variety of different features. In order to accommodate a wide variety of fixtures, the mounting bodies preferably include up to 29 positions for receiving electrical contacts.

In most instances, the electrical contact plates can be provided with electrical contacts in the form of a plurality of pins and barrel-type sockets. One of the electrical contact plates preferably includes an outer surface and recesses with electrical contact pins being provided in the recesses and not projecting outwardly beyond the outer surface of the electrical contact plate. This construction prevents inadvertent damage to the pins since they are shielded by the recesses.

The opposite electrical contact plate includes a plurality of projections, each including an electrical socket, for receipt in the corresponding recess in the other electrical contact plate. In an embodiment, one of the electrical contact plates includes a box recess, a plurality of cylindrical recesses, and a plurality of pins provided in the box recess and in the cylindrical recesses. The other electrical contact plate is then provided with a corresponding box projection, a plurality of post projections and a plurality of electrical sockets provided in the box and post projections.

The fixture lowering assembly also includes other components for aligning the first and second electrical connectors. In an embodiment, first and second spring assemblies resiliently mount the first and second connectors and each include a pair of guide posts extending through a pair of springs to mount the respective connector. Alignment posts extend outwardly from one set of guideposts and corresponding receptacles are provided on the other set of guide posts. The alignment posts come into contact with receptacles in the opposite guide posts prior to any contact between the first and second connectors in order to create a correct alignment between the components before the electrical connectors themselves are brought into contact.

The electrical contact plates of the first and second connectors can also include leading alignment members on one of the plates and corresponding receptacles on the other plate to further ensure correct alignment between the respective components. The combination of the alignment posts and receptacles on the guide posts, the alignment members and receptacles on the electrical contact plates, and the recesses and projections on the plates ensure correct alignment and insertion of the pins into the electrical sockets.

Other objects, advantages, and features of the present invention will become apparent from the following description and drawings.

DESCRIPTION OF THE PREFERRED EMBODIMENTS

Figure 1:
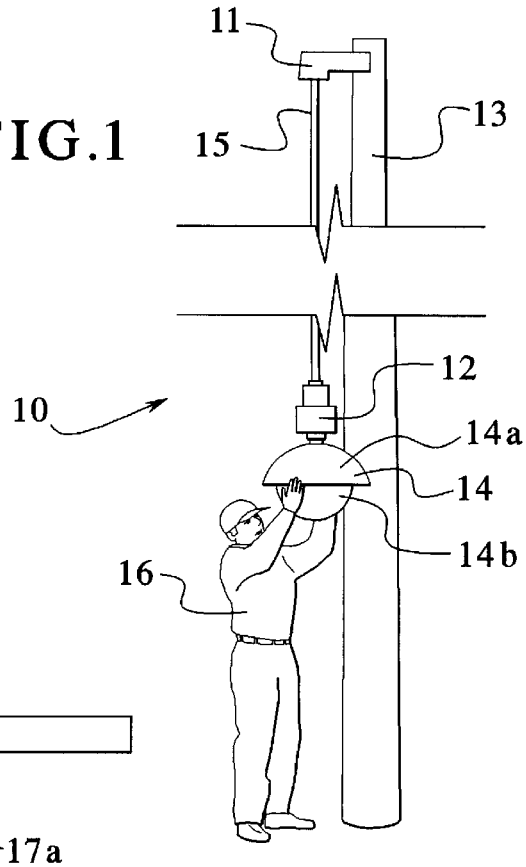
FIG. 1 is a front view showing the fixture lowering assembly of the present invention in use with the fixture in the lowered position for servicing.
Figure 2:
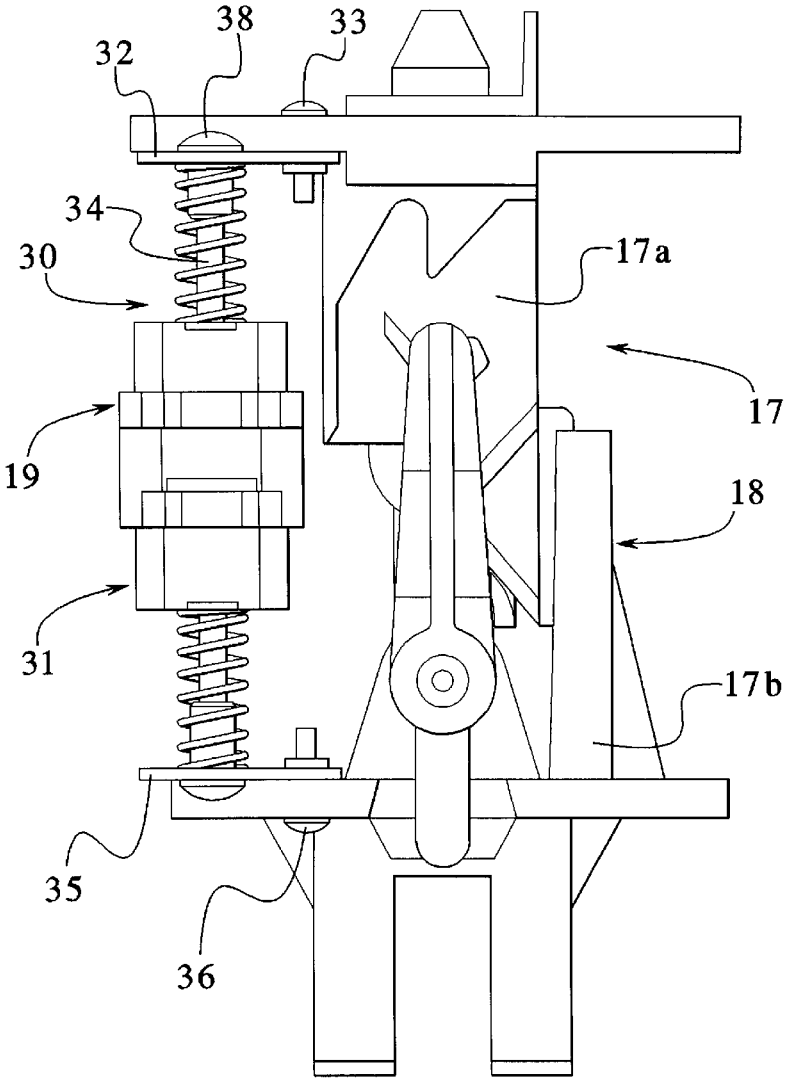
FIG. 2 is a side view illustrating the connector assembly of the fixture lowering assembly of the present invention.
Figure 3:
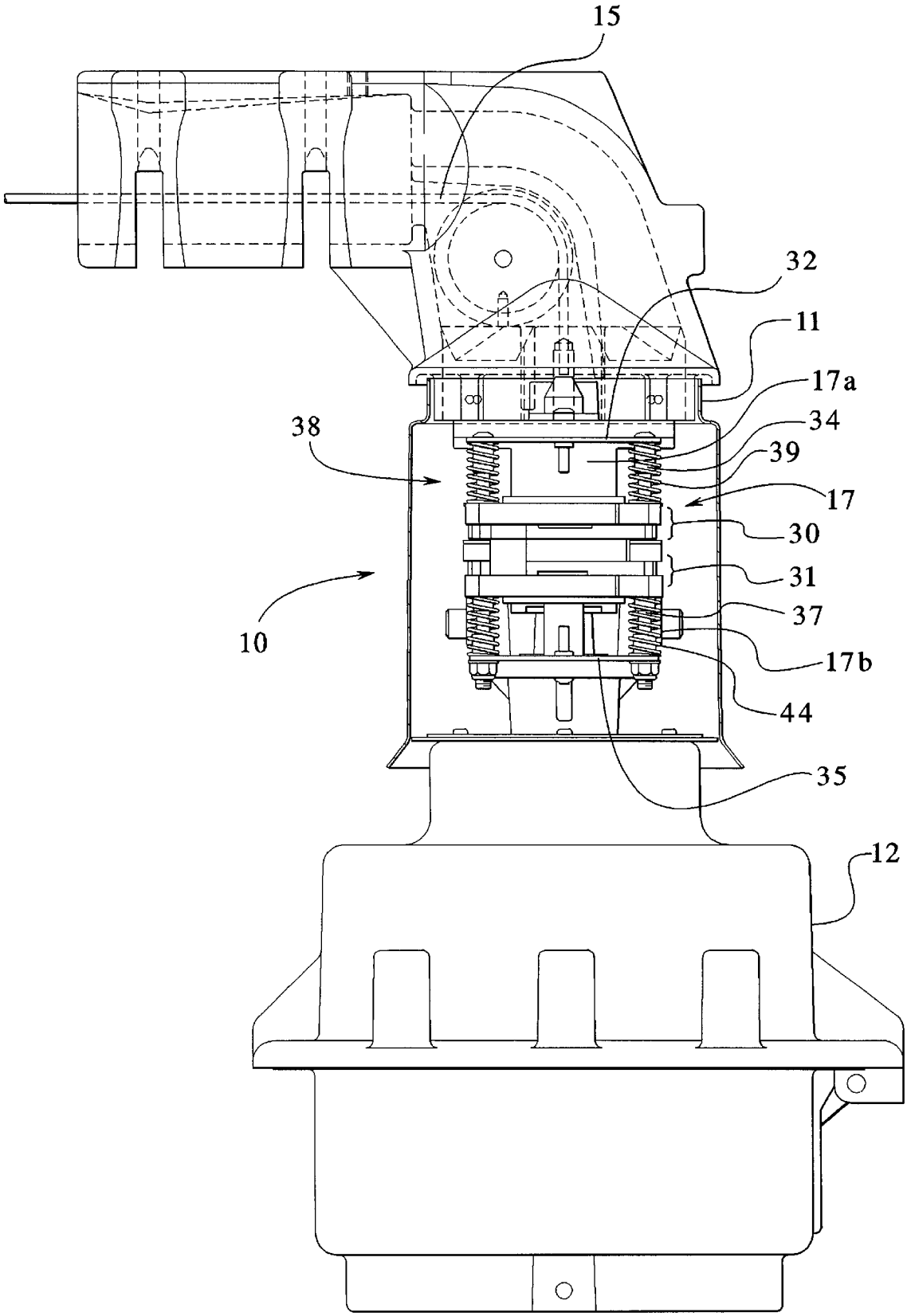
FIG. 3 is a partially cut-away side view illustrating the fixture lowering assembly of the present invention.

Referring to FIGS. 1 to 3, the numeral 10 generally designates the fixture lowering assembly of the present invention. The assembly 10 includes a fixed upper housing 11 which is mounted above ground level and is shown mounted at the top of a pole 13. While a pole mounting is shown, it will be understood by those skilled in the art that the mounting for upper housing 11 and the location and height of the elevation may vary considerably depending upon the application for which the fixture lowering assembly is intended.

The assembly 10 also includes a movable housing 12 which includes a fixture 14. The fixture 14, in the embodiment shown in the drawings, comprises a security and surveillance camera mounted within a backing 14*a* and a clear dome 14*b* for overhead viewing above ground level. Typically, such cameras require a plurality of electrical contacts in order to provide power to the fixture 14 and to relay a signal from the fixture back to a receiver or viewing system. Such cameras may require up to twenty-nine contact positions. While the invention will be generally described in connection with using a security and surveillance camera for fixture 14, it will be understood by those skilled in the art that the present invention may be used with a variety of electrical fixtures 14.

The fixture 14 is lowered on a cable 15 designed to withstand harsh weather conditions including gusting winds. In an embodiment, the lowering cable 15 comprises a 5⁄32 inch thick stainless steel aircraft cable. The cable 15 is used for lowering fixture 14 for a variety of purposes such as servicing by personnel 16, installation of a new camera or other fixture, changing film or lenses, etc. A standard winch system (not shown) may be used for lowering cable 15. The winch system need not be described herein in detail since such systems are well-known to those skilled in the art.

In order to connect and disconnect the upper fixed housing 11 and lower movable housing 12 of the lowering assembly 10, a connect unit generally designated at 17 is provided between these two components. The connect unit 17 has a top half 17*a* and a bottom half 17*b* which may be formed of cast stainless steel or similar suitable materials. The connect unit 17 generally includes two main assemblies: (1) a latching assembly generally designated at 18 for connecting and disconnecting the two halves 17*a* and 17*b*; and (2) a contact assembly generally designated at 19 for connecting and disconnecting the electrical contacts between the two components.

The latching assembly 18 is well-known to those skilled in the art and is used in suspension connectors manufactured by Lighting and Lowering Systems, Broadview, Ill., the assignee of this application. For example, the latching mechanism has been employed in product model No. SCU-2A. The latching assembly 18 will therefore only be described in general detail.

Figure 4:
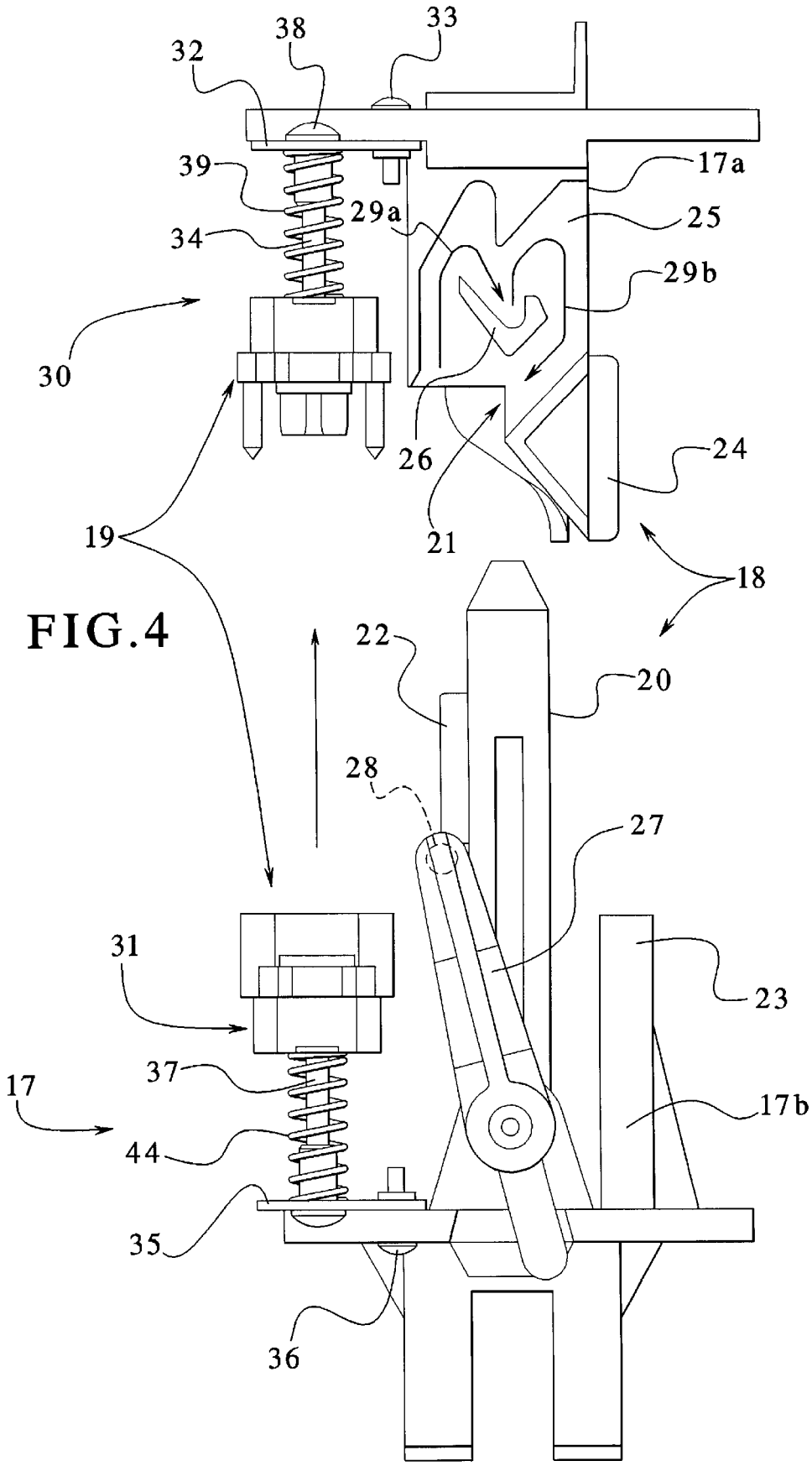
FIG. 4 is a side view illustrating the upper and lower connector assemblies of the fixture lowering assembly of the present invention.

Referring to FIG. 4, the latching assembly 18 generally includes an elongated post on one half 17*b* of the unit 17 that fits into a socket 21 on the other half 17*a* of the connect unit 17. The post 20 is provided with guide member 22 and socket 21 includes a respective slot (not shown) for receiving such guide member 22. The lower half 17*b* of the connect unit 17 further includes a guide sleeve 23 for receiving an elongated guide member 24. These features ensure a proper alignment of the two halves 17*a* and 17*b* and of the latching assembly.

The top half 17*a* of the connect unit 17 defines a slotted channel 25 and a central hook member 26. The other half 17*b* of the connect unit 17 includes a pair of pivotally mounted latch arms 27, which each include pins 28 for passage in guide channel 25 and engaging hook 26. As is known by those skilled in the art, when the lower half 17*b* is pulled upward by cable 15 to connect with the upper half 17*a*, the arms 27 pivot and pins 28 pass in the direction of arrow 29a through channel 25 and engage hook 26 to latch the two halves together. When it is desired to disconnect the two halves 17*a* and 17*b*, the lower half 17*b* is again pulled upward on cable 15 so that the pins 28 on the latch arms 27 follow the path of arrow 29*b* to then unlatch the two members. As stated above, such a latching assembly is well-known to those skilled the art and need not be described in further detail herein.

Referring to FIGS. 2 and 4, the contact assembly 19 for forming the electrical connection comprises a first connector 30 and a second connector 31. The top half 17*a* of the connect unit 17 is connected to a mounting plate 32 by a bolt or screw 33 and a pair of upper guide posts 34 extend through mounting plate 32. The upper guide posts 34 support the first connector 30 for forming an electrical connection with the second connector 31.

The bottom half 17*b* of the connect unit 17 is connected to a second mounting plate 35 by a bolt or screw 36 and a pair of lower guide posts 37 pass through the mounting plate 35. The second connector 31 is supported by the mounting posts 37 for connection with the first connector 30.

Figure 5:
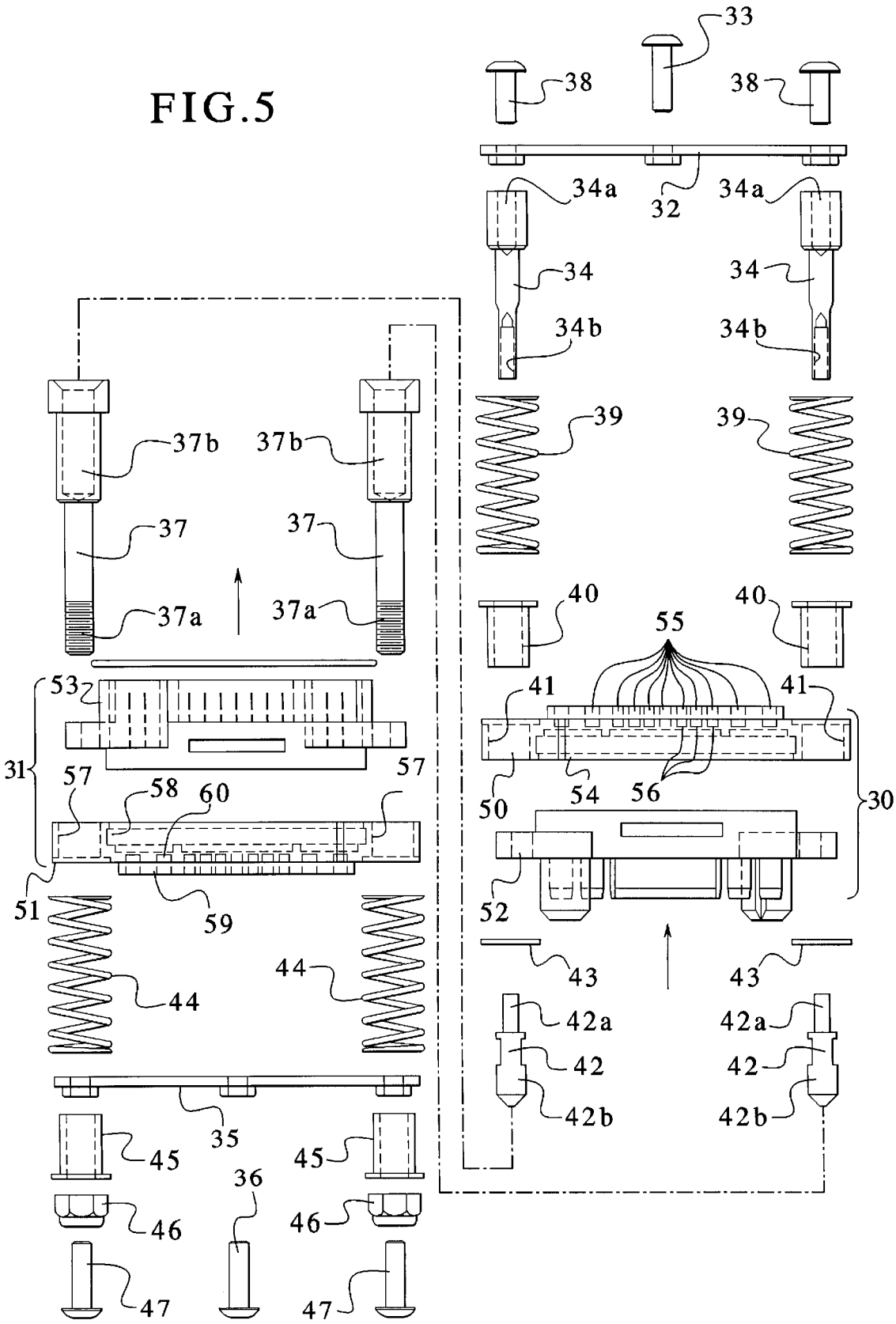
FIG. 5 is an exploded view of the first and second connectors of the fixture lowering assembly of the present invention.

Referring to FIG. 5, the first and second connectors 30 and 31 and mounting assemblies are presented in exploded views that show the components in more detail. Screw 33 is used to connect mounting plate 32 to the upper half 17*a* of the connect unit 17, and screws 38 are used to secure upper guide posts 34 to mounting plate 32 by connecting with threaded bores 34*a* in posts 34. The upper guide posts 34, when assembled, extend though a pair of springs 39 to support the first connector 30. Specifically, the upper guide posts 34 pass through flange bearings 40 that are received in apertures 41 in first connector 30. A pair of upper alignment posts 42 extend through a pair of retainers 43 and have threaded ends 42a extend through the first connector 30 and are secured into threaded recesses 34*b* of the upper guide posts 34. The upper alignment posts 42 and retainers 43 secure the first connector 30 on the guide posts 34 but permit the first connector 30 to slide on flange bearings 40 along guide posts 34 against the biasing force of the spring 39.

The lower guide posts 37 include threaded ends 37*a* that, when assembled, pass through the second connector 31 and a second pair of springs 44 and through mounting plate 35. The threaded ends 37*a* of the lower guide posts 37 then pass through a pair of flange bearings 45 and are threadably connected to a pair of adjustment nuts 46. the nuts 46 can be turned on threads 37*a* to adjust the length of the lower guide posts 37 that projects through the mounting plate 35. The screws 47 secure the mounting plate 35 to the bottom half of assembly 17*b*.

An optional rubber gasket 48 can be provided between the first and second connectors 30 and 31 to facilitate the moisture proof seal between the two connectors.

In the embodiment shown in the drawings, the first and second connectors 30 and 31 each respectively include a mounting body 50 and 51 and a corresponding electrical contact plate 52 and 53. The mounting bodies 50 and 51 are intended to be of a standard configuration that permit the electrical contacts, in the form of electrical contact plates 51 and 52, to be interchanged and selected depending upon the particular fixture used with the lowering assembly of this invention.

In the embodiment shown in the drawings, mounting body 50 defines apertures 41 the receive flanges 40 for permitting slidable movement on upper guide posts 34. The mounting body 50 also defines a receptacle 54 so that a selected electrical contact plate 52 may be inserted therein. The opposite side of mounting body 50 defines a plurality of pre-drilled apertures 55 that have a thin membranes 56 separating the apertures 55 from the receptacle 54. The pre-drilled holes 55, and thin membranes 56, permit the holes to be selectively drilled through to correspond to the appropriate number of electrical contacts needed for the particular fixture used with the assembly. The thin membrane 56 protects the circuitry by sealing off unused apertures 55 whereas the thin membrane 56 can be easily removed depending upon the number of electrical contacts needed.

The mounting body 51 is similar to mounting body 50 and includes apertures 57 that encapsulate upper shank of lower guide posts 37. The mounting body 51 also includes a receptacle 58 for receiving electrical contact plate 53, as well as apertures 59 and thin membranes 60 for permitting selective connection of electrical contacts through body 51 to contact with the electrical contact plate 53.

Typically, the type of fixture, such as a surveillance and security camera, used with the lowering assembly 10 of the present invention will use pin and socket connectors. In the embodiment shown in the drawings, electrical contact plate 52 is adapted for providing socket connectors and electrical contact plate 53 is adapted for providing pin connectors. However, it will be understood by those skilled in the art that the pin and socket connectors can be used with either the first or second connector 30, 31 or that other types of electrical contacts can be used to make the electrical connection depending upon the particular application for which the invention is intended.

Figure 6:
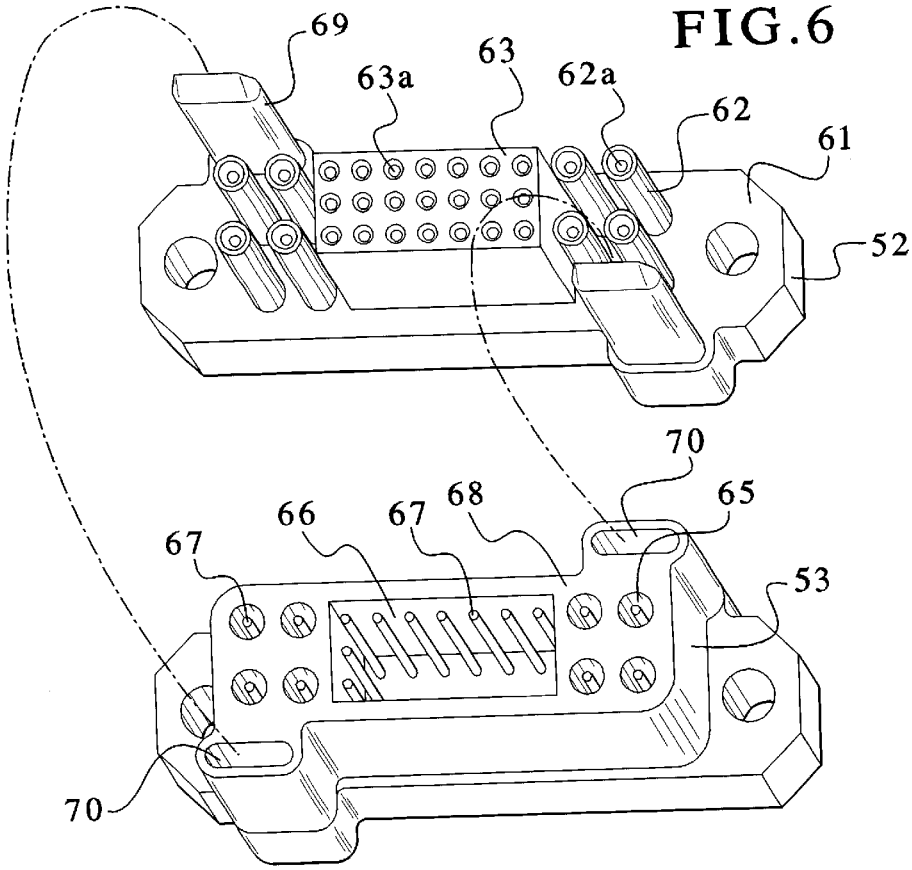
FIG. 6 is a perspective view of the first and second electrical contact plates of the fixture lowering assembly of the present invention.
Figure 7:
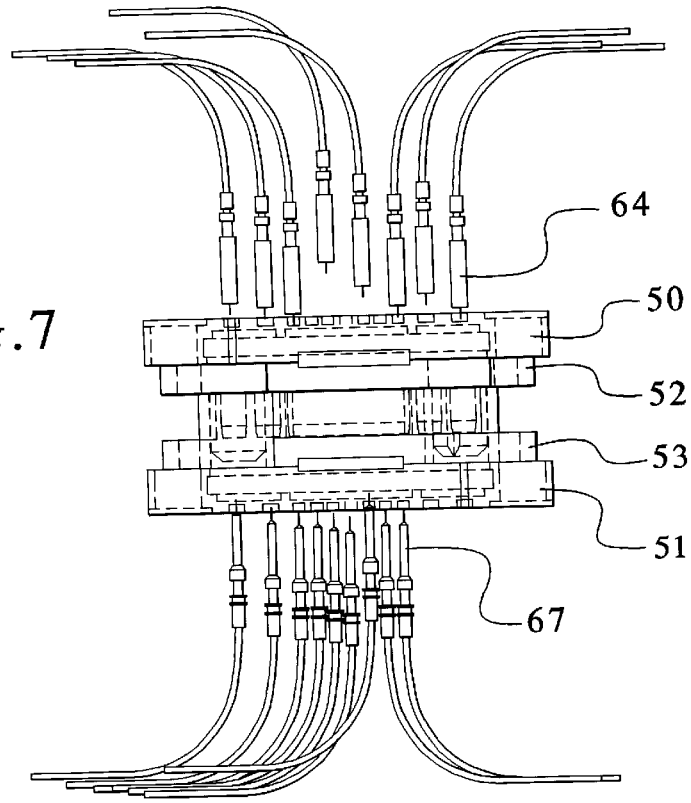
FIG. 7 is an exploded side view illustrating the electrical connecting plates and pin and socket connectors of the fixture lowering assembly of the present invention.

FIGS. 6 and 7 illustrate one type of electrical contact plate 52 for use with socket connectors and one type of electrical contact plate 53 for use with pin connectors. In particular, electrical contact plate 52 includes a base 61, a plurality of rod-like projections 62, and a block projection 63. The rod-like projections 62 define apertures 62*a* and electrical sockets 64 are provided inside of projections 62 for receiving a pin. Similarly, block projection 63 defines a plurality of apertures 63a which each contain an electrical socket 64. The electrical sockets 64 are inserted through apertures 55 and thin membranes 56 in the mounting body 50 in order to provide the desired number of electrical sockets 64 depending upon the number of electrical contacts needed. In the embodiment shown in the drawings, the electrical contact plate 52 is adapted to provide up to twentynine electrical contacts which would advantageously accommodate most types of surveillance and security cameras.

The electrical contact plate 53 includes circular recesses 65 corresponding to the rod-like projections 62 of contact plate 52 and a block recess 66 corresponding to the block projection 63 of the contact plate 52. A plurality of pins 67 project upwardly through recesses 65 and block recess 66 for mating with the corresponding apertures 62*a* and 63*a* in the opposite projections 62 and 63. As shown in FIG. 7, the electrical contact pins 67 are inserted through the openings 59 and thin membranes 60 of the mounting body 51. In the embodiment shown in the drawings, the electrical mounting plate 53 is also capable of including up to twenty-nine different contact pins. However, the number of electrical contact pins 67, and sockets 64 on plate 52, can be selectively varied depending upon the electrical contacts needed for the fixture and depending upon the particular application for which the invention is intended.

Referring to FIG. 5, the alignment posts 42 include projecting heads 42*b* that are adapted to fit in receptacles 37*b* defined by the opposite guide posts 37. The heads 42*b* contact the receptacles 37*b* during connection prior to any contact between the pins 67 and the sockets 64. Thus, the alignment posts 42 facilitate correct alignment of the pins 67 and sockets 64 in order to prevent damage thereto or a misaligned connection.

The particular configuration of electrical contact plates 52 and 53 also facilitates the correct alignment of the electrical contacts. The posts 62 and cylindrical openings 65 help ensure proper alignment of the pins and sockets because the posts 62 and opening 65 engage in proper alignment prior to any contact between the actual pins and sockets. Likewise, the block projection 63 and the corresponding recess 66 align prior to contact between the pins 67 and socket 64 to ensure correct alignment. Notably, the pins 67 also do not project outwardly beyond the outer face 68 of the electrical contact plate 53 and are preferably recessed below the face 68 to prevent damage to the pins during the disconnection and connection process.

To further facilitate correct alignment of the components of the two electrical contact plates 52 and 53, contact plate 52 is provided with leading alignment members 69 that extend outwardly beyond posts 62 and block projection 63. The opposite contact plate 53 is provided with elongated receptacles 70 for receiving alignment members 69 during the connecting process. By front running actual contact between the electrical contact plates 52 and 53, the leading alignment members 69 and receptacles 70 further bring the components into proper alignment to facilitate the connection between the electrical contacts. Pursuant to the embodiment given in the drawings, the leading alignment members 69 and corresponding receptacle 70 may advantageously have a generally rectangular cross-section and do not project outwardly too much from the entire assembly while still having a sufficient surface area engagement to help ensure proper alignment of the components.

In addition to facilitating alignment, the employment of projections and recesses on the two electrical contact plates 52 and 53 further provides a moisture-proof seal about the contact points between the pins and sockets. The moisture-proof seal is very advantageous since a fixture lowering assembly is commonly used in outside environments subject to the elements.

The first and second connectors 30 and 31 are each respectively mounted on their guide posts 34 and 37 and springs 39 and 44 to provide a "fully floating" connection. This fully floating assembly of the first and second connectors 30 and 31 facilitates correct alignment of the components because the connectors can adjust or "give" if needed during the alignment and connection process.

During the operation of disconnecting or connecting the two halves 17*a* and 17*b* of the connect unit 17, the springs 39 and 44 that respectively support the first and second connectors 30 and 31 compress in order to permit the lever arms 27 and pins 28 to engage and lock on hook 26 to connect the two components together. However, it should be noted that neither of the springs 39 or 44 is alone capable of sufficient compression to permit latching of the first and second halves 17*a* and 17*b* together. Rather, both springs 39 and 44 must cooperate to provide sufficient compression to permit latching of the two components 17*a* and 17*b* together. In an embodiment, the latching assembly 18 requires a stroke length of approximately ¾ of an inch for pin 28 to be latched or unlatched from hook 26. In this embodiment, each of the spring mountings for the first and second connectors 30 and 31 provide approximately ⅜ of an inch movement to accommodate for the latching and unlatching stroke. However, it will be understood that the latching stroke length and the degree of movement of the first and second connectors 30 and 31 could be varied depending upon the particular application for which the fixture lowering assembly is intended.

To insert the pins 67 into the sockets 64, a coupling force is required. In an embodiment, the coupling force is equal to thirty-two pounds of pressure. To overcome this force, the springs 39 and 44 combine to provide a force greater than the coupling force between the pins 67 and sockets 64. In an embodiment, each of the springs 39 and 44 provide approximately sixteen pounds of pressure which, when the forces are combined, is sufficient to overcome the coupling force required between the pins 67 and sockets 64. However, it should be noted that the spring force provided by each of the individual springs 39 and 44 is each less than the total force required to overcome the coupling force required between the pins 67 and socket 64. However, it will be understood by those skilled in the art that the coupling force and the offset force provided by the springs will vary depending upon the particular application for which the socket lowering assembly is intended.

During the connection and disconnection process, the fully floating design, provided by the springs 39 and 44 that resiliently mount the first and second connectors 30 and 31 permits each of the connectors 30 and 31 to follow each other throughout the connection and disconnection process. In other words, the first and second connectors 30 and 31 remain coupled throughout the latching and unlatching process and the spring mounting of each connector prevents a partial disconnection or connection which could cause damage to the fixture due to an imbalance in the connection of the electrical contacts. The spring mounts thus maintain the connection until the first and second connectors 30 and. 31 are fully extended on their respective guideposts 34 and 37 so that disconnection occurs evenly and uniformly to prevent inadvertent damage to the system.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

I claim:

1. A fixture lowering assembly comprising:

a fixed housing mounted above ground level;

a moveable fixture housing connected to a fixture;

a connect unit including an upper portion mounted on said fixed housing and a lower portion mounted on said movable fixture housing;

a latching assembly constructed to selectively connect and disconnect said upper and said lower portions of said connect unit;

a first connector provided on said upper portion and a second connector provided on said lower portion of the connect unit;

a first spring assembly resiliently mounting said first connector on said upper portion of the connect unit;

a second spring assembly resiliently mounting said second connector on said lower portion of the connect unit; and the first and second spring assemblies opposing one another.

2. The assembly of claim 1 in which said first and second connectors each include a mounting body, and electrical contact plates are provided in said mounting bodies.

3. The assembly of claim 2 in which each of said mounting bodies is adapted to receive up to twenty-nine electrical contacts.

4. The assembly of claim 2 in which one of said electrical contact plates is provided with a plurality of pin contacts and the other of said electrical contact plates is provided with a plurality of electrical sockets.

5. The assembly of claim 4 in which said electrical contact plates form a moisture-proof seal about said pins and said sockets.

6. The assembly of claim 2 in which one of said electrical contact plates includes a outer surface and recesses, and said pins are provided in said recesses and do not project outwardly beyond said outer surface of said electrical contact plate.

7. The assembly of claim 2 in which said one of said electrical contact plates includes a box recess, and a plurality of cylindrical recesses and a plurality of pins provided in said box recess and said cylindrical recesses, and said other of said electrical contact plates includes a corresponding box projection, a plurality of post projections, and a plurality of electrical sockets provided in said box projection and said post projection, plate.

8. The assembly of claim 2 in which one of said electrical contact plates includes a pair of leading alignment members projecting outwardly from said plate beyond electrical contacts contained therein and the other of said electrical contact plates includes receptacles adapted to slidably receive said leading adjustment members.

9. The assembly of claim 8 in which said leading aligned members have a generally rectangular cross section and said receptacles on the other of said electrical contact plates have a generally rectangular cross-section.

10. The assembly of claim 1 in which said first spring assembly includes at least one guide rod and spring resiliently mounting said first connector and said second spring assembly includes at least one guide rod and spring resiliently mounting said second connector.

11. The assembly of claim 1 in which said first spring assembly resiliently mounting said first connector includes a pair of guide posts extending through a pair of springs, said first connector being slidably mounted on one end of the guide rods and the other end of the guide rods being secured to the upper portion of the connect unit.

12. The assembly of claim 11 in which said spring assembly resiliently mounting said second connector includes a pair of guide posts extending through a pair of springs, said first connector being slidably mounted on one end of the guide rods and the other end of the guide rods being secured to the lower portion of the connect unit.

13. The assembly of claim 12 in which one of said upper and lower guide posts include alignment posts extending adjacent to and outwardly beyond the respective one of said first and second connectors and the other of said upper and lower guide posts include receptacles for receiving said alignment posts, whereby, said alignment posts come into contact with said receptacles prior to contact between the first and second connectors in order to create correct alignment before said contact.

14. A fixture lowering assembly comprising:

a fixed housing mounted above ground level;

a movable fixture housing connected to a fixture;

a connect unit including an upper portion mounted on said fixed housing and a lower portion mounted on said movable fixture housing;

a self acting latch permitting remote connection and disconnection of said upper and said lower portions of said connection unit;

a first connector provided on said upper portion and a second connector provided on said lower portion of said connect unit;

electrical contacts provided on said first and second connectors for forming an electrical connection in between; and springs resiliently mounted on said first and second connectors on said upper and lower portions on said connect unit said springs opposed to one another.

15. The assembly of claim 14 in which said first and second connectors each include a mounting body, and electrical contact plates are provided in said mounting bodies.

16. The assembly of claim 15 in which each of said mounting bodies is adapted to receive up to twenty-nine electrical contacts.

17. The assembly of claim 15 in which one of said electrical contact plates is provided with a plurality of pin contacts and the other of said electrical contact plates is provided with a plurality of electrical sockets.

18. The assembly of claim 15 in which said electrical contact plates form a moisture-proof seal about said pins and said sockets.

19. The assembly of claim 15 in which one of said electrical contact plates includes a outer surface and recesses, and said pins are provided in said recesses and do not project outwardly beyond said outer surface of said electrical contact plate.

20. The assembly of claim 15 in which said one of said electrical contact plates includes a box recess, and a plurality of cylindrical recesses and a plurality of pins provided in said box recess and said cylindrical recesses, and said other of said electrical contact plates, includes a corresponding box projection, a plurality of post projections, and a plurality of electrical sockets provided in said box projection and said post projection, plate.

21. The assembly of claim 15 in which one of said electrical contact plates includes a pair of leading alignment members projecting outwardly from said plate beyond electrical contacts contained therein and the other of said electrical contact plates includes receptacles adapted to slidably receive said leading adjustment members.

22. The assembly of claim 21 in which said leading aligned members have a generally rectangular cross section and said receptacles on the other of said electrical contact plates have a generally rectangular cross-section.

23. The assembly of claim 14 in which said first spring assembly includes at least one guide rod and spring resiliently mounting said first connector and said second spring assembly includes at least one guide rod and spring resiliently mounting said second connector.

24. The assembly of claim 14 in which said first spring assembly resiliently mounting said first connector includes a pair of guide posts extending through a pair of springs, said first connector being slidably mounted on one end of the guide rods and the other end of the guide rods being secured to the upper portion of the connect unit.

25. The assembly of claim 24 in which said spring assembly resiliently mounting said second connector includes a pair of guide posts extending through a pair of springs, said first connector being slidably mounted on one end of the guide rods and the other end of the guide rods being secured to the lower portion of the connect unit.

26. The assembly of claim 25 in which one of said upper and lower guide posts include alignment posts extending adjacent to and outwardly beyond the respective one of said first and second connectors and the other of said upper and lower guide posts include receptacles for receiving said alignment posts, whereby, said alignment posts come into contact with said receptacles prior to contact between the first and second connectors in order to create correct alignment before said contact.

27. A suspension connector assembly of the type having a multi-contact electrical connector mounted within a stationary housing, a movable mating electrical connector mounted within a movable housing member with the movable housing member adapted to be raised and lowered towards and away from the stationary housing to bring the electrical connectors into and out of engagement with one another and a latching mechanism for latching and unlatching the stationary and movable housing members and for connecting said electrical connectors during latching and unconnecting said electrical connectors during unlatching, the latching mechanism having a latching stroke length from a time of initial contact of the electrical connectors during which the movable housing member continues to move towards the stationary housing member and subsequently moves against the stationary housing member to a latched position, each of the electrical connections being mounted to the respective stationary and movable housing by resilient connection allowing each connector to move with respect to the housing independently of the housing towards and away from the other connector, springs biasing the electrical connectors towards one another, the resilient movement of the connectors each being limited to an individual movement less than the stroke length, the combined movement of both connectors being greater than the stroke length whereby the movement of the latching mechanism through the stroke length is accommodated by movement of both electrical connectors.

* * * * *